US011355300B2

(12) United States Patent
Urrea et al.

(10) Patent No.: US 11,355,300 B2
(45) Date of Patent: Jun. 7, 2022

(54) ACTIVE/PASSIVE AUTOMOTIVE FUSE MODULE

(71) Applicant: Littelfuse, Inc., Chicago, IL (US)

(72) Inventors: Julio C. Urrea, Chicago, IL (US); Gary M. Bold, Palatine, IL (US); Juergen Scheele, Bremen (DE)

(73) Assignee: Littelfuse, Inc., Chicago, IL (US)

( * ) Notice: Subject to any disclaimer, the term of this patent is extended or adjusted under 35 U.S.C. 154(b) by 51 days.

(21) Appl. No.: 16/854,111

(22) Filed: Apr. 21, 2020

(65) Prior Publication Data

US 2020/0357594 A1 Nov. 12, 2020

Related U.S. Application Data

(60) Provisional application No. 62/844,358, filed on May 7, 2019.

(51) Int. Cl.
*H01H 85/06* (2006.01)
*H01H 85/20* (2006.01)
*H01H 85/38* (2006.01)

(52) U.S. Cl.
CPC ..... *H01H 85/06* (2013.01); *H01H 85/205* (2013.01); *H01H 85/2045* (2013.01);
(Continued)

(58) Field of Classification Search
CPC .. H01H 85/06; H01H 85/2045; H01H 85/205; H01H 85/38; H01H 2085/2055; H01H 2085/208; H02H 5/041
(Continued)

(56) References Cited

U.S. PATENT DOCUMENTS 6,295,930 B1 * 10/2001 Kume ..... H01H 39/006 102/202.5
6,753,755 B2 * 6/2004 Montague ..... H01R 13/4534 337/187
(Continued)

FOREIGN PATENT DOCUMENTS

DE 29913553 U1 12/1999
FR 3051282 A1 11/2017
GB 2489101 A 9/2012

OTHER PUBLICATIONS

T. Keim, "Developments in Pyrotechnic-Assisted Fuses [Happenings]," in IEEE Power Electronics Magazine, vol. 5, No. 3, pp. 12-17, Sep. 2018, doi: 10.1109/MPEL.2018.2851123 (Year: 2018).*
(Continued)

*Primary Examiner* — Kevin J Comber
*Assistant Examiner* — Sreeya Sreevatsa
(74) *Attorney, Agent, or Firm* — KDB PLLC

(57) ABSTRACT

An exemplary embodiment of active/passive automotive fuse module in accordance with the present disclosure may include an electrically insulating base, a fuse plate including a bus bar portion disposed on a top surface of the base above a projectile cavity formed in the base, the fuse plate further including a fusible portion electrically connected to the bus bar portion and adapted to open when an amount of current flowing through the fuse plate exceeds a current rating of the active/passive automotive fuse module, the active/passive automotive fuse module further including a pyrotechnic interrupter (PI) disposed atop the base and including a projectile positioned above the bus bar portion, the PI configured to drive the projectile through the bus bar portion upon actuation of the PI.

14 Claims, 4 Drawing Sheets

(52) U.S. Cl.
CPC ..... *H01H 85/38* (2013.01); *H01H 2085/208* (2013.01); *H01H 2085/2055* (2013.01)

(58) Field of Classification Search
USPC ..... 361/104
See application file for complete search history.

(56) References Cited

U.S. PATENT DOCUMENTS

| | | | | |
|---|---|---|---|---|
| 7,123,124 | B2 * | 10/2006 | Caruso | H01H 39/006 337/157 |
| 10,566,160 | B2 * | 2/2020 | McTigue | H01H 39/00 |
| 11,043,344 | B2 * | 6/2021 | von zur Muehlen | H02H 3/087 |
| 2004/0041682 | A1 * | 3/2004 | Pasha | H01H 39/006 337/401 |
| 2017/0330715 | A1 * | 11/2017 | von zur Muehlen | H01L 31/042 |
| 2018/0147941 | A1 * | 5/2018 | Kube | B60L 58/24 |
| 2019/0287751 | A1 * | 9/2019 | Gonthier | H01H 39/006 |
| 2021/0066011 | A1 * | 3/2021 | Konkol | H01H 9/10 |

OTHER PUBLICATIONS

T. Sakuraba, R. Ouaida, S. Chen and T. Chailloux, "Evaluation of Novel Hybrid Protection Based on Pyroswitch and Fuse Technologies," 2018 International Power Electronics Conference (IPEC-Niigata 2018—ECCE Asia), 2018, pp. 2153-2157, doi: 10.23919/IPEC.2018.8507793 (Year: 2018).*

European Search Report dated Aug. 26, 2020 for European Patent Application 20172693.2-1202.

* cited by examiner

ACTIVE/PASSIVE AUTOMOTIVE FUSE MODULE

CROSS-REFERENCES TO RELATED APPLICATIONS

This application claims the benefit of U.S. Provisional Patent Application No. 62/844,358, filed May 7, 2019, which is incorporated by reference herein in its entirety.

FIELD OF THE DISCLOSURE

This disclosure relates generally to the field of circuit protection devices and relates more particularly to an active/passive automotive fuse module that includes both passive and active circuit protection elements.

BACKGROUND OF THE DISCLOSURE

Fuses are commonly implemented in automobile electrical systems for providing overcurrent protection. Most automobile fuses are "passive" devices that include fuse elements that are configured to carry a rated amount of electrical current during normal operation. If current flowing through a fuse element exceeds the fuse element's rated current, the fuse element will melt, disintegrate, or otherwise separate, thereby arresting the current to prevent or mitigate damage to connected electrical components.

In some cases, it may be desirable to "actively" create a physical opening in an electrical circuit regardless of an amount of electrical current flowing through the circuit. For example, if an automobile is involved in a collision, it may be desirable to physically open an electrical circuit in the automobile to ensure that connected electrical components are deenergized to mitigate the risk of fire and/or electrocution in the aftermath of the collision. To that end, so-called pyrotechnic interrupters (PIs) have been developed which can be selectively actuated upon the occurrence of specified events to interrupt the flow of current in a circuit. For example, in the case of an automobile collision, a controller (e.g., an airbag control unit, battery management system, etc.) may send an initiation signal to a PI, causing a pyrotechnic initiator within the PI to be detonated. A resultant increase in pressure within the PI rapidly forcibly drives a projectile through a conductor that extends through the PI. Electrical current flowing through the PI is thereby interrupted, and the projectile, which is formed of a dielectric material, provides an electrically insulating barrier between separated portions of the conductor to prevent electrical arcing therebetween.

In certain automobile applications it may be desirable to implement both passive and active circuit protection elements. It may further be desirable to implement such elements in a compact, space-saving form factor that facilitates convenient installation and that is well suited for high voltage applications.

It is with respect to these and other considerations that the present improvements may be useful.

SUMMARY

This Summary is provided to introduce a selection of concepts in a simplified form further described below in the Detailed Description. This Summary is not intended to identify key features or essential features of the claimed subject matter, nor is the summary intended as an aid in determining the scope of the claimed subject matter.

An exemplary embodiment of an active/passive automotive fuse module in accordance with the present disclosure may include an electrically insulating base, a fuse plate including a bus bar portion disposed on a top surface of the base above a projectile cavity formed in the base, the fuse plate further including a fusible portion electrically connected to the bus bar portion and adapted to open when an amount of current flowing through the fuse plate exceeds a current rating of the active/passive automotive fuse module, the active/passive automotive fuse module further including a pyrotechnic interrupter (PI) disposed atop the base and including a projectile positioned above the bus bar portion, the PI configured to drive the projectile through the bus bar portion upon actuation of the PI.

Another exemplary embodiment of an active/passive automotive fuse module in accordance with the present disclosure may include an electrically insulating base, a fuse plate including a bus bar portion disposed on a top surface of the base and above a projectile cavity formed in the base, first and second fusible portions extending perpendicularly from first and second ends of the bus bar portion into respective first and second fuse cavities formed in the base on opposite side of the projectile cavity, the first and second fusible portions adapted to open when an amount of current flowing through the fuse plate exceeds a current rating of the active/passive automotive fuse module, and first and second terminal portions extending from lower termini of the first and second fusible portions, respectively, for connecting the active/passive automotive fuse module within a circuit. The active/passive automotive fuse module may further include a pyrotechnic interrupter (PI) disposed atop the base, the PI including a pyrotechnic initiator and a projectile positioned above the bus bar portion, wherein the pyrotechnic initiator is configured to detonate and force the projectile through the bus bar portion upon reception of an initiation signal by the PI.

DETAILED DESCRIPTION

An active/passive automotive fuse module in accordance with the present disclosure will now be described more fully with reference to the accompanying drawings, in which preferred embodiments of the active/passive automotive fuse module are presented. It will be understood, however, that the active/passive automotive fuse module may be embodied in many different forms and should not be construed as being limited to the embodiments set forth herein. Rather, these embodiments are provided so that this disclosure will convey certain exemplary aspects of the active/passive automotive fuse module to those skilled in the art.

Figure 1:
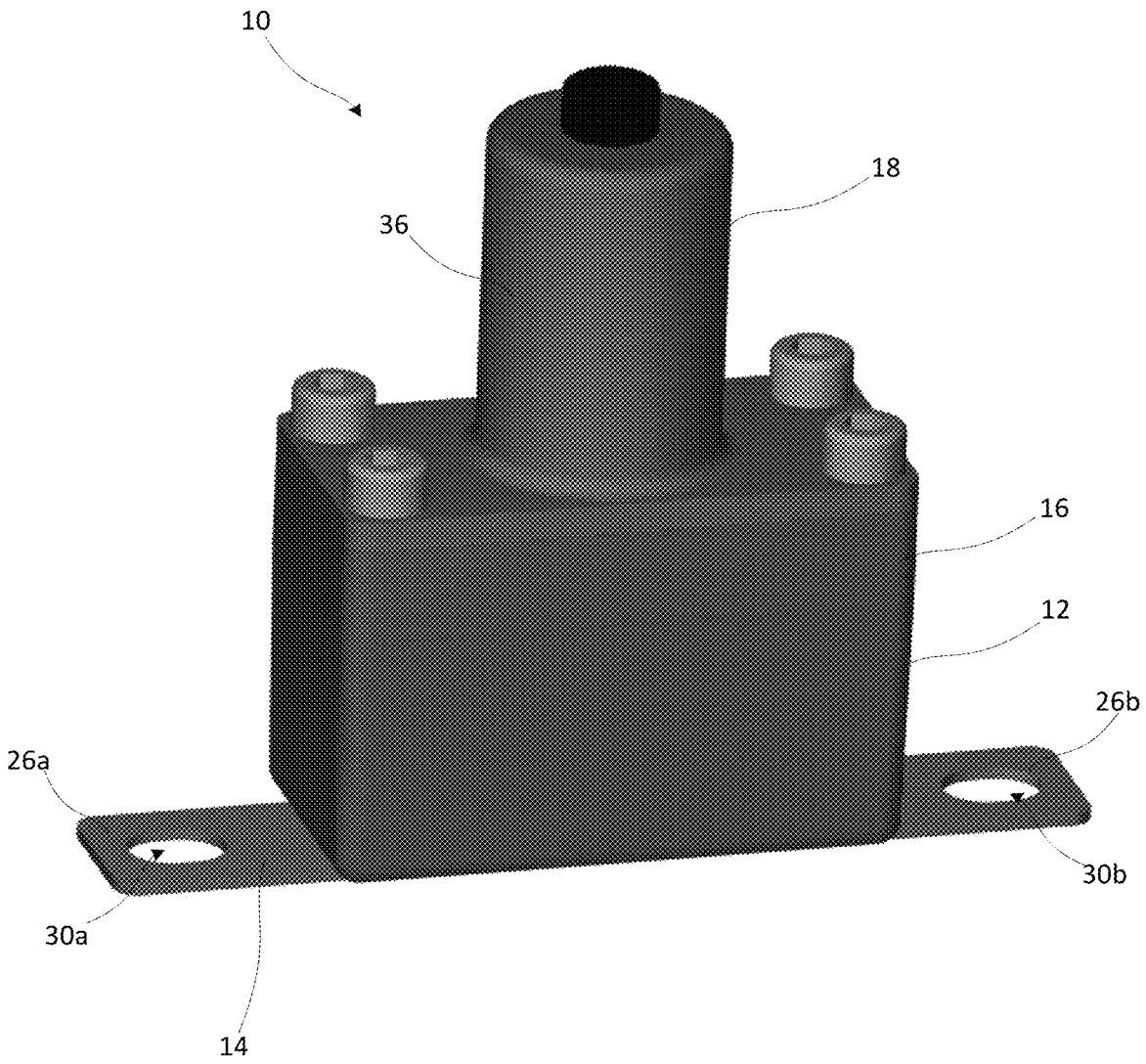
FIG. 1 is a perspective view illustrating an active/passive automotive fuse module in accordance with an exemplary embodiment of the present disclosure.
Figure 2:
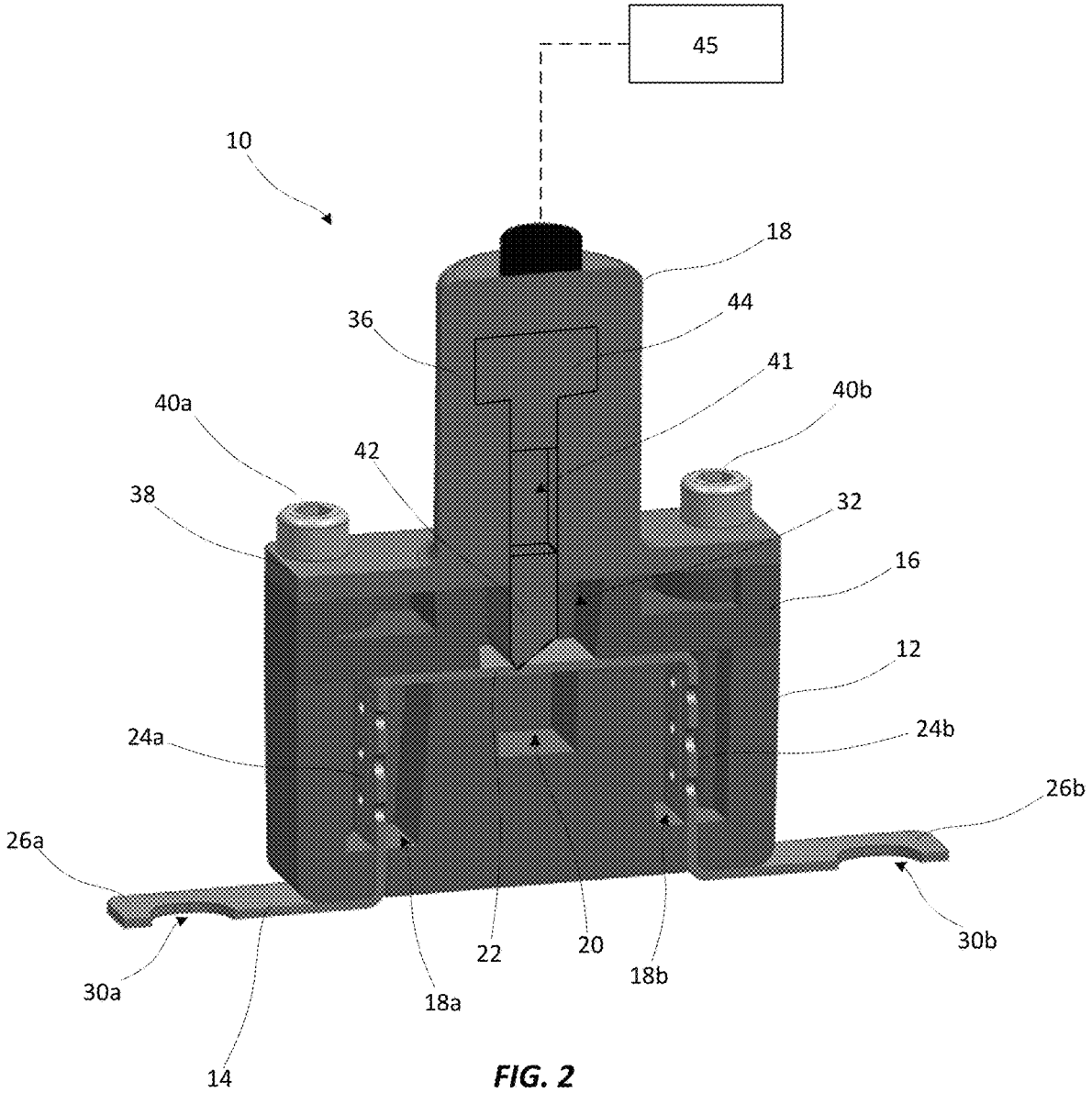
FIG. 2 is a cross sectional view illustrating the active/passive automotive fuse module shown in FIG. 1 in a non-actuated state.
Figure 3:
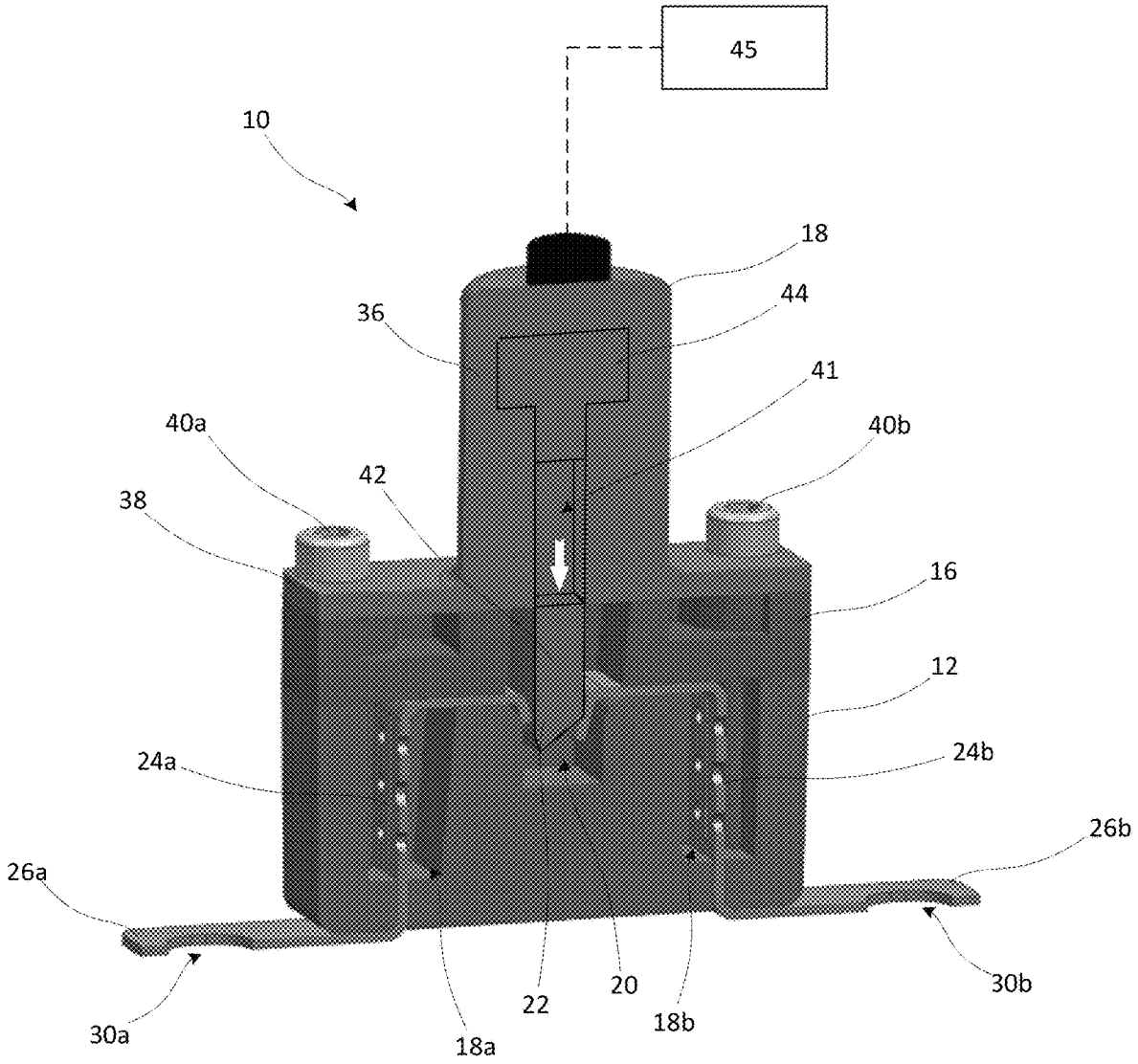
FIG. 3 is a cross sectional view illustrating the active/passive automotive fuse module shown in FIG. 1 in an actuated state.

Referring to FIGS. 1-3, a perspective view and cross-sectional views illustrating a Active/Passive automotive fuse module 10 (hereinafter "the fuse module 10") in accordance with an exemplary, non-limiting embodiment of the present disclosure is shown. For the sake of convenience and clarity, terms such as "front," "rear," "top," "bottom," "up," "down," "vertical," and "horizontal" may be used herein to describe the relative placement and orientation of various components of the fuse module 10, each with respect to the geometry and orientation of the fuse module 10 as it appears in FIGS. 1-3. Said terminology will include the words specifically mentioned, derivatives thereof, and words of similar import.

The fuse module 10 may generally include a base 12, a fuse plate 14, a spacing cap 16, and a pyrotechnic interrupter (PI) 18. The base 12 may be a substantially rectangular member formed of an electrically insulating material (e.g., plastic, polymer, ceramic, etc.). As illustrated in the cross-sectional view of the fuse module 10 shown in FIG. 2, the base 12 may include vertically-elongated first and second fuse cavities 18*a*, 18*b* formed in the top surface thereof. The first and second fuse cavities 18*a*, 18*b* may be substantially identical and may have lower termini (e.g., floors) located above the bottom surface of the base 12. The base 12 may further include a projectile cavity 20 formed in the top surface thereof, horizontally intermediate the fuse cavities 18*a*, 18*b*. The projectile cavity 20 may be shorter than the fuse cavities 18*a*, 18*b*. The present disclosure is not limited in this regard.

The fuse plate 14 may be formed from a single piece of conductive material (e.g., stamped from a single sheet of copper) and may include a bus bar portion 22, first and second fusible portions 24*a*, 24*b*, and first and second terminal portions 26*a*, 26*b*. The bus bar portion 22 may be disposed on the top surface of the base 12 in a horizontal orientation and may extend from a first end disposed above the first fuse cavity 18*a*, over the projectile cavity 20, to a second end disposed above the second fuse cavity 18*b*. The first and second fusible portions 24*a*, 24*b* may extend perpendicularly downwardly from the first and second ends of the bus bar portion 22, respectively, into the respective first and second fuse cavities 18*a*, 18*b*. Lower ends of the first and second fusible portions 24*a*, 24*b* may extend through respective slots formed in the floors of the first and second fuse cavities 18*a*, 18*b* and may be terminate below the bottom surface of the base 12. The first and second terminal portions 26*a*, 26*b* may extend perpendicularly outwardly (i.e., away from the projectile cavity 20) from the lower termini of the first and second fusible portions 24*a*, 24*b*, respectively, and may include respective mounting apertures 30*a*, 30*b* formed therethrough for connecting the fuse module 10 within a circuit (e.g., between a battery and one or more electrical loads in an automobile).

The first and second fusible portions 24*a*, 24*b* may be configured to melt, disintegrate, or otherwise open if current flowing through the fuse plate 14 exceeds a predetermined threshold, or "current rating," of the fuse module 10. In various examples, the first and second fusible portions 24*a*, 24*b* may include perforations, slots, thinned or narrowed segments, and/or various other features for making the first and second fusible portions 24*a*, 24*b* more susceptible to melting or opening than other portions of the fuse plate 14. In a non-limiting example, the first and second fusible portions 24*a*, 24*b* may be configured to have a current rating in a range between 30 amps and 1000 amps. In various embodiments, an arc-quenching, fuse filler material, such as sand, silica, or the like (not shown), may partially or entirely fill the first and second fuse cavities 18*a*, 18*b* and may substantially surround the first and second fusible portions 24*a*, 24*b* for quenching electrical arcs that could otherwise propagate upon opening of the first and second fusible portions 24*a*, 24*b* during an overcurrent condition. The fuse module 10 may therefore be particularly well suited for high-voltage applications. While the fuse module 10 has been described and illustrated as having two fusible portions 24*a*, 24*b*, various alternative embodiments of the fuse module 10 are contemplated that may include only one fusible portion or more than two fusible portions.

The spacing cap 16, which may be formed from an electrically insulting material that is the same as, or is similar to, that from which the base 12 is formed, may be disposed atop the base 12 and the bus bar portion 22 of the fuse plate 14. The spacing cap 16 may define a projectile channel 32 that extends vertically therethrough. The projectile channel 32 may be disposed directly above the bus bar portion 22 and the projectile cavity 20 of the base 12. While the spacing cap 16 is depicted as being separate from the base 12 it is contemplated that, in various alternative embodiments, the base 12 and the spacing cap 16 may be formed as a single, contiguous body.

The present disclosure is not limited in this regard.

The PI 18, which may be of a commercially available variety (e.g., sold under the trade name "PYROSWITCH" by AUTOLIV), may include a housing 36 having a mounting flange 38. The housing 36 may be disposed atop the spacing cap 16, with mechanical fasteners 40*a*, 40*b* extending through the mounting flange 38, the spacing cap 16, and the base 12 for fastening the aforementioned components together in a vertically stacked relationship as shown. The housing 36 may have a vertically oriented, hollow shaft 41 extending therethrough, the shaft 41 having a first, open end located directly above the projectile channel 32 of the spacing cap 16. The shaft 41 may contain a projectile 42 that extends into the projectile channel 32 and rests atop the bus bar portion 22 of the fuse plate 14. In various embodiments, the projectile 42 may have a pointed or wedge-shaped tip disposed in a confronting relationship with the bus bar portion 22. The present disclosure is not limited in this regard.

The housing 36 may further containing a pyrotechnic initiator 44 disposed adjacent to, and configured to discharge an explosive output into, a second, top end of the shaft 41. In various embodiments, the pyrotechnic initiator 44 may be operatively connected to a controller 45 (e.g., an airbag control unit, battery management system, etc.) located within an automobile. Upon the occurrence of a specified event, such as an automobile collision, the controller 45 may send an initiation signal to the PI 18, causing the pyrotechnic initiator 44 to be detonated. The explosive output of the detonation may result in an increase in pressure within shaft 41 rapidly forcing the projectile 42 downwardly, through the bus bar portion 22 of the fuse plate 14 as shown in FIG. 3. The bus bar portion 22 is thereby severed, and electrical current flowing through the fuse plate 14 is interrupted. The projectile 42, which may be formed of a dielectric material, may provide an electrically insulating barrier between the separated ends of the bus bar portion 22 to prevent electrical arcing therebetween.

Figure 4:
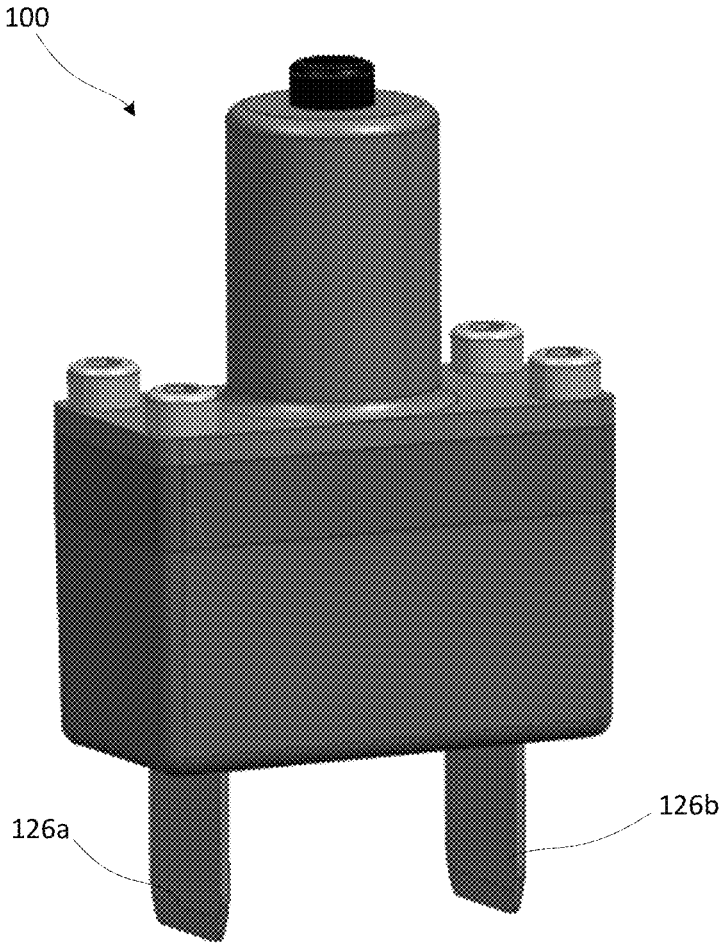
FIG. 4 is a perspective view illustrating an active/passive automotive fuse module in accordance with another exemplary embodiment of the present disclosure.

Referring to FIG. 4, a perspective view illustrating another active/passive automotive fuse module 100 (hereinafter "the fuse module 100") in accordance with an exemplary, non-limiting embodiment of the present disclosure is shown. The fuse module 100 may be substantially identical to the fuse module 10 described above, with the exception of the first and second terminal portions 26*a*, 26*b* of the fuse plate 14 of the fuse module 10 being replaced by vertically extending first and second terminal prongs 126*a*, 126*b*. The first and second terminal prongs 126*a*, 126*b* may accommodate "plug in" applications of the fuse module 100 in which the first and second terminal prongs 126*a*, 126*b* may be mated to complementary receptacles for connecting the fuse module 100 within a circuit.

In view of the foregoing description, it will be appreciated that the active/passive automotive fuse modules of the present disclosure facilitate the implementation of both passive and active circuit protection elements (e.g., conventional fuse elements and a pyrotechnic interrupter) in single, compact, space-saving form factor that facilitates convenient installation within an automobile. It will be further appreciated that the active/passive automotive fuse modules of the present disclosure may be particularly well-suited for high voltage applications.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. An active/passive automotive fuse module comprising:
an electrically insulating base;
a fuse plate comprising:
a bus bar portion disposed on a top surface of the base and above a projectile cavity formed in the base; and
a fusible portion electrically connected to the bus bar portion and adapted to open when an amount of current flowing through the fuse plate exceeds a current rating of the active/passive automotive fuse module, the fusible portion comprising a first fusible portion extending from a first end of the bus bar portion, the fuse plate further comprising a second fusible portion extending from a second end of the bus bar portion, wherein the fusible portion is disposed within a fuse cavity in the base, the bus bar portion is disposed above the fuse cavity, and the fusible portion extends perpendicularly from the bus bar portion; and
a pyrotechnic interrupter (PI) disposed atop the base and including a projectile positioned above the bus bar portion, the PI configured to drive the projectile through the bus bar portion upon actuation of the PI.

2. The active/passive automotive fuse module of claim 1, wherein the fuse cavity is at least partially filled with an arc quenching material that surrounds the fusible portion.

3. The active/passive automotive fuse module of claim 1, wherein the first fusible portion is disposed within a first fuse cavity in the base and the second fusible portion is disposed within a second fuse cavity in the base.

4. The active/passive automotive fuse module of claim 3, wherein the first and second fuse cavities are at least partially filled with an arc quenching material that surrounds the first and second fusible portions.

5. The active/passive automotive fuse module of claim 1, further comprising a spacing cap disposed between the base and the PI and having a projectile channel extending therethrough, wherein a portion of the projectile extends into the projectile channel.

6. The active/passive automotive fuse module of claim 1, further comprising a controller operatively connected to a pyrotechnic initiator of the PI and adapted to send an actuation signal to the pyrotechnic initiator upon the occurrence of a predetermined event.

7. The active/passive automotive fuse module of claim 1, wherein the fuse plate further comprises a terminal portion extending from the fusible portion, through the base, and having a mounting aperture formed therethrough for facilitating electrical connection within a circuit.

8. The active/passive automotive fuse module of claim 1, wherein the fuse plate further comprises a terminal portion extending from the fusible portion, through the base, and terminating in a flat prong adapted to be plugged into a receptacle for facilitating electrical connection within a circuit.

9. An active/passive automotive fuse module comprising:
an electrically insulating base;
a fuse plate comprising:
a bus bar portion disposed on a top surface of the base and above a projectile cavity formed in the base;
first and second fusible portions extending perpendicularly from first and second ends of the bus bar portion into respective first and second fuse cavities formed in the base on opposite side of the projectile cavity, the first and second fusible portions adapted to open when an amount of current flowing through the fuse plate exceeds a current rating of the active/passive automotive fuse module, wherein the bus bar portion is disposed above the first fuse cavity and the first fusible portion extends perpendicularly from the bus bar portion; and
first and second terminal portions extending from lower termini of the first and second fusible portions, respectively, for connecting the active/passive automotive fuse module within a circuit; and
a pyrotechnic interrupter (PI) disposed atop the base, the PI including a pyrotechnic initiator and a projectile positioned above the bus bar portion, wherein the pyrotechnic initiator is configured to detonate and force the projectile through the bus bar portion upon reception of an initiation signal by the PI.

10. The active/passive automotive fuse module of claim 9, wherein the first and second fuse cavities are at least partially filled with an arc quenching material that surrounds the first and second fusible portions.

11. The active/passive automotive fuse module of claim 9, further comprising a spacing cap disposed between the base and the PI and having a projectile channel extending therethrough, wherein a portion of the projectile extends into the projectile channel.

12. The active/passive automotive fuse module of claim 9, further comprising a controller operatively connected to the pyrotechnic initiator of the PI and adapted to send an actuation signal to the pyrotechnic initiator upon the occurrence of a predetermined event.

13. The active/passive automotive fuse module of claim 9, wherein each of the first and second terminal portions has a mounting aperture formed therethrough for facilitating electrical connection within a circuit.

14. The active/passive automotive fuse module of claim 9, wherein each of the first and second terminal portions terminates in a flat prong adapted to be plugged into a receptacle for facilitating electrical connection within a circuit.

* * * * *